United States Patent [19]

Desjardins et al.

[11] Patent Number: 4,850,588

[45] Date of Patent: Jul. 25, 1989

[54] BALANCING APPARATUS FOR SURF BOARD

[76] Inventors: Gilles Desjardins, 15,770 Francois Labernade, Montreal, Quebec, Canada, H1A 4V2; Guy Tremblay, 7 - 34th Ave., Montreal, Quebec, Canada, H1A 4M1; Paul-Yvon Valois, 3 - 31st Ave., Pointe-aux-Trembles, Quebec, Canada, H1A 4X8

[21] Appl. No.: 193,934

[22] Filed: May 13, 1988

[51] Int. Cl.[4] ..... A63B 7/08; A63B 69/18; A63G 31/00

[52] U.S. Cl. ..... 272/111; 272/17; 272/1 B; 272/97

[58] Field of Search ..... 272/1 R, 1 B, 1 C, 16, 272/17, 18, 54, 96, 97, 111, 146, 144, 66, 62–64, 93, 109; 434/247, 253

[56] References Cited

U.S. PATENT DOCUMENTS

| | | | |
|---|---|---|---|
| 1,789,680 | 1/1931 | Gwinnett | 272/18 |
| 2,212,460 | 8/1940 | Stephenson | 272/66 |
| 2,524,238 | 10/1950 | Soule | 272/1 C |
| 2,661,954 | 12/1953 | Koci | 272/1 C |
| 4,509,743 | 4/1985 | Lie | 272/146 |
| 4,749,180 | 6/1988 | Boomer | 272/97 |

*Primary Examiner*—S. R. Crow

[57] ABSTRACT

A balancing apparatus having a surf board, an upstanding support post and a main universal joint connected in-between the bottom of the surf board and the top of the support post. The surf board can be tilted relatively to the support post about two different axes passing through the center of the support post.

1 Claim, 3 Drawing Sheets

FIG. 1
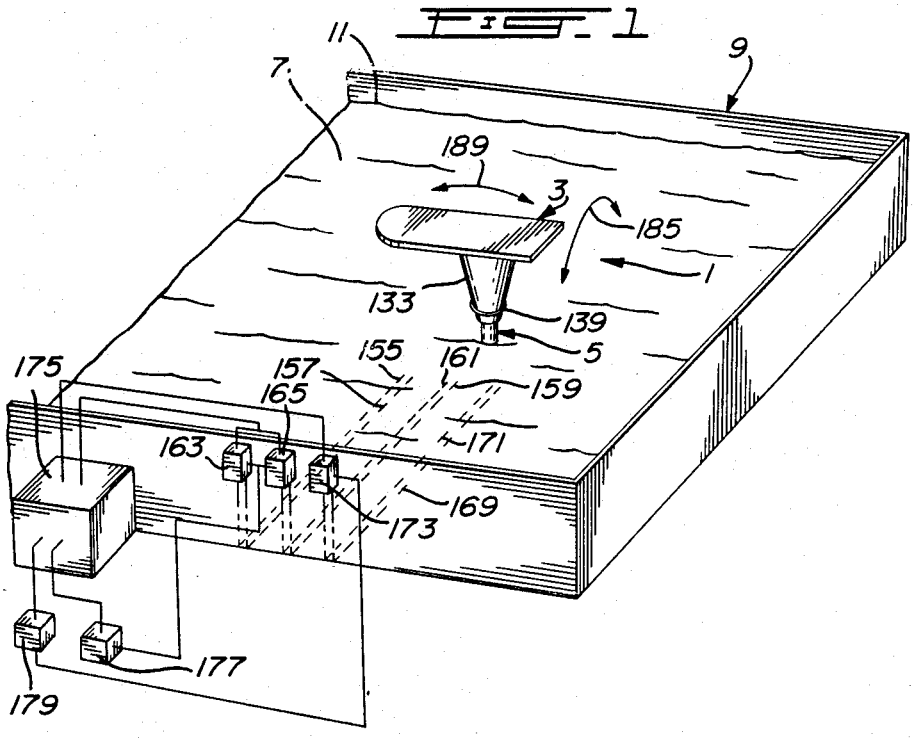
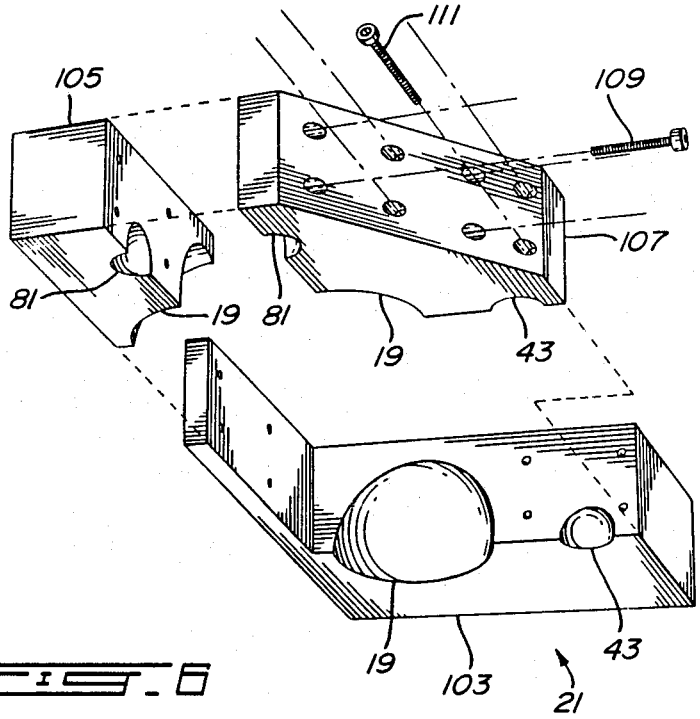
FIG. 6

BALANCING APPARATUS FOR SURF BOARD

This invention is directed toward a balancing apparatus.

The invention is more particularly directed to a balancing apparatus having a platform, on which a person can stand, mounted on top of a support post. Means are provided for tilting the platform to continually change its attitude relative to the support post while a person balances on the platform.

The balancing apparatus can be used to teach people, particularly athletes, better balance. The apparatus can also be used as an amusement device to see how long people can remain on the platform while it is tilting.

The apparatus is particularly suited for mounting in a pool or other body of water and using a surfboard as the platform. The tilting motion imparted to the surfboard can approximate the motion a surfer would encounter surfing and thus the apparatus can be used to teach people how to balance on a surfboard.

The balancing apparatus generally comprises a platform, on which a person can stand, mounted on the top of a support post by means of a main universal joint. The main universal joint allows the platform to tilt or pivot about the support post. The apparatus includes means connected between the platform and the post for tilting the platform on the post about first and second axes passing through the center of the main universal joint. The first axis is preferably horizontal and located in the vertical plane containing the longitudinal axis of the surfboard. The second axis is also preferably horizontal and located transverse to the first axis. Thus, the tilting means provides a side to side yawing motion to the surfboard on the post about the first axis and also provides fore-and-aft pitching motion to the surfboard on the post about the second axis. The tilting means can be operated to simultaneously combine the yawing and pitching motions. The tilting means can also be operated to have the yawing motion operate at a different rate from the pitching motion. The tilting means preferably comprise first and second tilting units each employing an hydraulic actuator that is connected with universal joint means to both the surfboard and the support post. The first tilting unit controls the yawing motion of the surfboard and the second unit controls the pitching motion of the surfboard.

The height of the surfboard can also be varied. This can preferably be done by making the support post from telescoping post sections so that its length can be varied. Another hydraulic actuator can be used to move the post sections relative to each other to change the post length and thus vary the height of the surfboard. Tis post actuator could be operated simultaneously with the tilting actuators to add a third up and down motion to the yaw and pitch motions imparted to the surfboard.

The invention is particularly directed toward a balancing apparatus having a board on which a person can stand and an upstanding support post for the board. A main universal joint connects the bottom of the board to the top of the post. Tilting means are connected between the board and the post for tilting the board relative to the post about two axes passing through the center of the universal joint.

The invention will now be described in detail having reference to the accompanying drawings in which:

FIG. 1 is a perspective view of the balancing apparatus mounted in a pool;

FIG. 6 is an exploded, bottom view of the mounting block.

Figure 3:
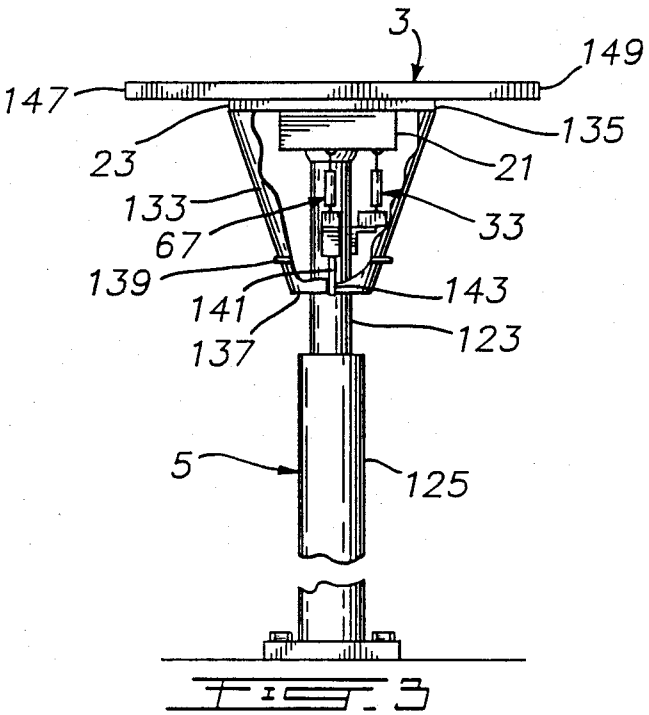
FIG. 3 is a front view of the balancing apparatus partly in section.
Figure 2:
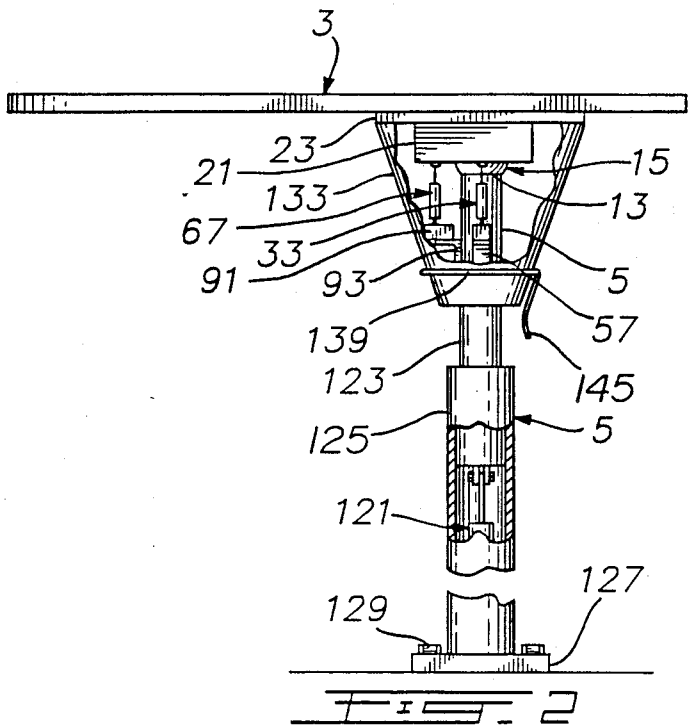
FIG. 2 is a side view of the balancing apparatus partly in section.

The balancing apparatus 1, in its preferred form, as shown in FIGS. 1 to 3, comprises a platform or board 3 mounted on top of a vertical support post 5. The board 3 preferably has the shape of a surfboard. The support post 5 is adapted to be mounted in water 7, such as in a pool 9. The surfboard 3 is mounted on the top of the post 5 above the level 11 of the water in the pool.

Figure 4:
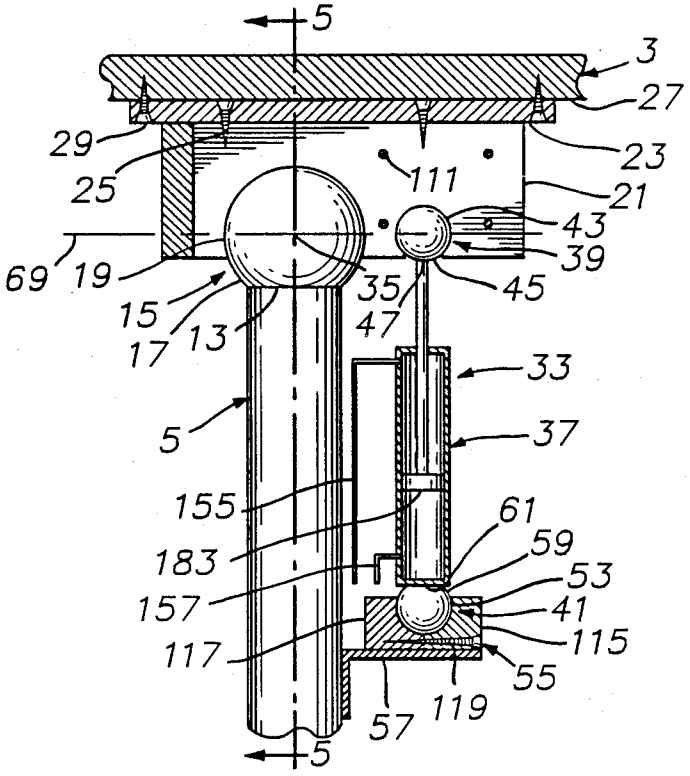
FIG. 4 is a cross-sectional detail view of the main universal joint.

The surfboard 3 is connected to the top 13 of the post 5 by a main universal joint 15. The main universal joint 15 comprises a main ball member 17 mounted on the top 13 of the post 5, and a main socket 19 formed in a main mounting block 21 mounted on the surfboard 3 as shown in FIG. 4. The main mounting block 21 is preferably mounted on a mounting plate 23 with suitable fasteners 25. The mounting plate 23, in turn, is mounted to the bottom surface 27 of the surfboard 3 with suitable fasteners 29. The main mounting block 21 is mounted to the surfboard 3 to have the main socket 19, which opens downwardly, located along the longitudinal axis of the surfboard, and slightly to the rear of its transverse axis. The main ball member 17 is mounted snugly within the socket 19, as will be described, to universally connect the surfboard 3 to the support post 5.

Tilting means are provided for tilting the surfboard 3, about the universal joint 15. The tilting means include a first tilting unit 33 for tilting the surfboard 3 about the universal joint 15 about a first axis that passes through the center of the main universal joint. The first axis preferably is a longitudinal axis 35 vertically aligned with the longitudinal axis of the surfboard 3. The first tilting unit 33 has a first hydraulic actuator 37 connected with a first, top universal joint 39 to the surfboard 3 and connected with a first, bottom universal joint 41 to the support post 5. The first, top universal joint 39 preferably comprises a first, top socket 43 formed in mounting block 21, and a first, top ball member 45 mounted at the top end 47 of the actuator 37. The first, top socket 43 formed in mounting block 21, and a first, top ball member 45 mounted at the top end 47 of the actuator 37. The first, top socket 43 opens downwardly and is located to the side of the main socket 19 on a plane that extends through the center of the main universal joint 15, transverse to the longitudinal axis 35. The ball member 46 is snugly mounted within the socket 43 as will be described. The first, bottom universal joint 41 has a first bottom socket 53 formed in a first mounting block 55 mounted on a first bracket 57 which in turn is fastened to the side of the post 5 some distance below the surfboard 3.

The first, bottom socket 53 opens upwardly and is normally located beneath the first, top socket 43. A first, bottom ball member 59 is mounted at the bottom end 61 of the actuator 37. The ball member 59 is mounted snugly within the socket 53 as will be described.

The tilting means include a second tilting unit 67 for tilting the surfboard 3 about the main universal joint 15 about a second axis 69 that passes through the center of the main universal joint. The second axis 69 preferably is a transverse axis, transverse to the longitudinal axis 35. The second tilting unit 67 is similar to the first tilting unit 33 and has a second hydraulic actuator 73 connected with a second, top universal joint 75 to the surfboard 3 and connected with a second, bottom universal joint 77 to the support post 5. The second, top universal joint 75 comprises a second, top socket 81 formed in the mounting block 21, and a second, top ball member 83 mounted at the top end 85 of the second actuator 73. The second, top socket 81 opens downwardly and is located in front of the main socket 19 on a vertical plane containing the longitudinal axis 35. The second, top ball member 83 is snugly mounted in the second, top socket 81 as will be described. The second, bottom universal joint 77 has a second, bottom socket 89 formed in a second mounting block 91 mounted to a second bracket 93 which itself is fastened to the front of the post 5 some distance below the surfboard 3. The second, bottom socket 89 opens upwardly and is normally located beneath the second, top socket 81. A second, bottom ball member 97 is mounted at the bottom end 99 of the second actuator 73 and fits snugly within the socket 89 as will be described.

The main mounting block 21 preferably is made from three sections 103, 105, 107 as shown in FIG. 6 which are bolted together. The first section 103 contains one half of the main socket 19 and one half of first, top socket 43. The second section 105 contains one quarter of the main socket 19 and one half of the second, top socket 81. The third section 107 contains one quarter of the main socket 19, one half of the first top socket 43, and one half of the second, top socket 81.

The second section 105 is assembled to the first section 103, with the main ball 17 within the main socket 19; and the third section 107 is then assembled to the first and second sections 103, 105 with the first and second top balls 45, 83 located within the first and second top sockets 43, 81. Bolts 109 connect the first, second and third sections together in a direction transverse to the longitudinal axis 35 and bolts 111 connect the first and third sections 103, 107 together in a direction parallel to the longitudinal axis 35.

Both the first and second mounting blocks 55, 91 are made in two sections 115, 117 each section containing one half of the first and second bottom sockets 53, 89 in each mounting block 55, 91 respectively. The sections 115, 117 are joined together with bolts 119 with the first and second ball members 59, 97 mounted in the sockets 53, 89 respectively.

The support post 5 preferably is adjustable in length with a main hydraulic actuator 121 within the post 5 for raising or lowering a top post section 123, which is telescopically mounted within a bottom post section 125. The bottom post section 125 is mounted on a bottom base plate 127 which in turn can be fixed to the bottom of the pool by suitable fasteners 129. The first and second mounting blocks 55, 91 are mounted on the top post section 123.

If desired, a shield 133 may be mounted about the edge 135 of the mounting plate 23, the shield extending downwardly to cover the first and second actuators 37, 73. The shield 133 can taper inwardly and be supported near its bottom end 137 by a perforated ring 139. The ring 139 encircles the shield and is mounted to the top post section 123 by a brace 141 which extends through a slot 143 in the shield 133. Water may be conducted to the ring 139 by a hose 145. The water sprays up from ring 139 about the shield 133, and up past the sides 147, 149 of the board 3 to simulate spray generated during surfing.

The first and second hydraulic actuators 37, 73 are each connected by a pair of hydraulic fluid lines 155, 157 and 159, 161 to control valves 163, 165 respectively on the side of the pool 9 as shown in FIG. 1. The main hydraulic actuator 121 within the post 5 is connected by a pair of hydraulic fluid lines 169, 171 to a control valve 173 on the side of the pool 9.

Hydraulic fluid is circulated from a fluid reservoir 175, via a first fluid pump 177 to and from the first and second hydraulic actuators 37, 73 through the control valves 163, 165. Hydraulic fluid is circulated from the reservoir 175, via a second fluid pump 179, to and from the main hydraulic actuator 121 through the control valve 173.

Figure 5:
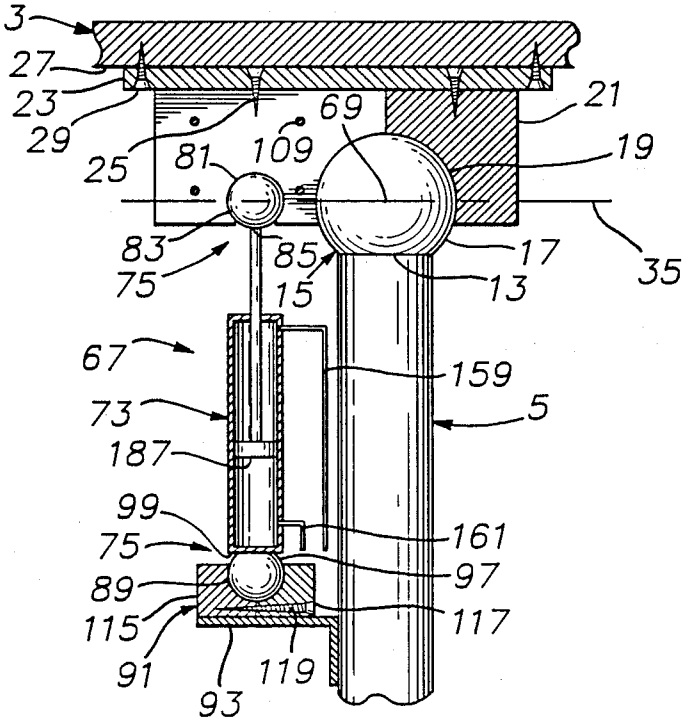
FIG. 5 is a view taken along line 5—5 of FIG. 4.

Operation of the first and second hydraulic actuators 37, 73 in the first and second tilting units 33, 67 will cause the surfboard 3 to move about the main universal joint 15. Movement of the piston 183 in the first actuator 37 above and below its centered position shown in FIG. 4 will cause the surfboard to yaw about the support post 5 as shown by the arrows 185 in FIG. 1. Similarly, movement of the piston 187 in the second actuator 73 above and below its centered position shown in FIG. 5 will cause the surfboard to pitch about the support post 5 as shown by the arrows 189 in FIG. 1.

The two actuators 37, 73 are operated simultaneously to give a combined pitch and yaw motion to the surfboard. The rates at which the actuators 37, 73 are operated can be made different or even variable to change the combined motion. The main actuator 121 can also be operated simultaneously with the first and second actuators 37, 73 to add an up-down motion to the surfboard and give still further varied motion to it. The rate of operation of the main actuator 121 is preferably different from the rate of operation of the first and second actuators 37, 73.

The apparatus can be provided with a computerized controller (not shown) operating the control valves 163, 165, 173 so that the rates of operation of each of the hydraulic actuators 37, 73, 121 can be easily set to operate at one rate, at different rates, or at variable rates. The rates of operation can be set between rates making it very easy to balance on the moving surfboard and rates making it very difficult.

What we claim is:

1. Balancing apparatus having a board on which a person can stand; an upstanding support post; a main universal joint connecting the bottom of the board to the top of the post; a first tilting unit connected between the board and the post for use in tilting the board on the universal joint back and forth about a first horizontal axis passing through the center of the universal joint; and a second tilting unit connected between the board and the post for use in tilting the board back and forth about a second horizontal axis passing through the center of the universal joint at an angle to the first horizontal axis; the first and second tilting units having a first and second hydraulic actuator connected at one end with a top universal joint to the board, and connected at its other end with a bottom universal joint to the post; further including a mounting block connected to the bottom of the board, the mounting block having a main socket forming part of the main universal joint; a first, top socket, forming part of the first actuator top universal joint, in the mounting block, and a second, top socket, forming part of the second actuator top universal joint, in the mounting block, the mounting block being made in three sections; the first section containing one-half of the main socket and one-half of the first top socket; the second section containing one-quarter of the main socket and one-half of the second top socket; the third section containing one-quarter of the main socket, one-half of the first top socket and one-half of the second top socket; and fastening means connecting the sections together in a manner to form the main and first and second top sockets.

* * * * *